US005467950A

United States Patent [19]

Dumitru

[11] Patent Number: 5,467,950

[45] Date of Patent: Nov. 21, 1995

[54] MULTIPURPOSE FOREARM/WRIST SUPPORT FOR USERS OF DATA INPUT DEVICES

[76] Inventor: David Dumitru, 3701 Wilson St., Austin, Tex. 78704

[21] Appl. No.: 15,331

[22] Filed: Feb. 9, 1993

[51] Int. Cl.[6] ..... B43L 15/00

[52] U.S. Cl. ..... 248/118.1; 400/715; 601/128

[58] Field of Search ..... 248/118.1, 118, 248/118.3, 118.5; 400/715; 601/128, 131; 128/845

[56] References Cited

U.S. PATENT DOCUMENTS

| | | | |
|---|---|---|---|
| 1,552,652 | 1/1925 | Setrakian | 248/118.5 |
| 1,627,635 | 5/1927 | Craig | 248/118.5 |
| 4,347,838 | 9/1982 | McCauley | 601/128 X |
| 4,973,176 | 12/1988 | Dietrich | 248/118 |
| 4,976,407 | 12/1989 | Schwartz et al. | 400/715 |
| 5,004,196 | 11/1989 | Gross | 248/118.3 |
| 5,005,560 | 4/1991 | Quam et al. | 601/113 |
| 5,040,757 | 8/1991 | Benaway | 248/118.3 |
| 5,050,826 | 9/1991 | Johnston | 248/118.3 |
| 5,088,668 | 4/1991 | Grimm | 248/118.3 |
| 5,125,606 | 6/1991 | Cassano et al. | 248/118 |
| 5,193,771 | 3/1993 | Hassel et al. | 248/118 |
| 5,263,474 | 11/1993 | Agader | 601/113 |

FOREIGN PATENT DOCUMENTS

| | | | |
|---|---|---|---|
| 2218878 | 10/1973 | Germany | 601/128 |
| 0212524 | 2/1941 | Switzerland | 601/118 |
| 2135202 | 8/1984 | United Kingdom | 601/128 |

*Primary Examiner*—Ramon O. Ramirez
*Attorney, Agent, or Firm*—Anthony England

[57] ABSTRACT

A forearm\wrist support comprised of a base (3), upon which rest or over which are suspended, beads or other suspendable, rotatable objects (1) affixed rotatably to the base by support rods (5) and fasteners such as cap nuts (2), and over which the user may roll his\her hands, wrists, forearms, or other body parts in a massaging motion, and\or under and between which stow writing instruments, documents, or other work related effects. The beads are affixed to the base by inserting the rods through holes in the beads and through similar holes in the base ends (4) so as to create rows of beads running along, as well as perpendicular to the long axis of the base, allowing a rolling motion back and forth across the uppermost surface of the beads. The invention being placed in close proximity to an electronic computing input device so as to facilitate simultaneous contact with the invention and the input device by the user. Alternate methods of construction and alternate embodiments are disclosed.

7 Claims, 3 Drawing Sheets

MULTIPURPOSE FOREARM/WRIST SUPPORT FOR USERS OF DATA INPUT DEVICES

BACKGROUND—FIELD OF INVENTION

The present invention relates to Forearm\Wrist Supports and Rests for use with computer keyboards and other data processing equipment, specifically to such supports and devices designed to delay and/or prevent certain Repetitive Motion Disorders (RMD).

BACKGROUND—DESCRIPTION OF PRIOR ART

The problem(s) of RMD is (are) well documented. For instance, according to the Bureau of Labor Statistics of the U.S. Dept. of Labor, RMD complaints have increased six fold between 1982 and 1990. According to all substantive sources this increase has been due in large part to the increase in use, in work environments as well as at home, of electronic computing equipment including but not limited to computer keyboards, "mice", and ten-key units.

Further, the present applicant submits that present literature on the subject of RMD, as well as remedies available at the time of this application do not address at least one parameter relating to RMD, that parameter being the unique form(s), in terms of linear measurements, in which each and every human body manifests itself. For example, no two humans have the same fingerprints (which are constituted of linear measures of the gradients between imprints left by the subjects skin upon a surface). Likewise, no two humans have identical linearly measurable proportions between the various musculoskelatal portions of their bodies. Specifically, centuries of empirical evidence tell us that the relationship between the sizes of the arms, palms, fingers, and other related body parts varies from person to person.

It follows then, that a support for the forearms and\or wrists of persons using electronic data input devices ought to be constructed in such a fashion as to allow for the greatest possible flexibility of motion of the relevant body parts with the least possible restriction of those motions so as to allow persons with "short" fingers to manipulate and/or reach keys, mouse positions, and\or Ten key positions with similar alacrity and ease as persons with other hand-finger size relationships. The latter holds true for persons with "long" fingers, and, common sense will dictate, for each person.

Moreover, RMD is well documented to effect chronic injuries and pain to portions of the human body not usually associated with electronic data input, as in the upper arms-shoulder, upper and lower back, etc.

Several remedial and\or curative therapies have been recommended by well known medical professionals in addressing RMDs and related ailments. These recommendations include; frequent breaks during the work routine, frequent changes of body position, and frequent massaging of body parts to reinstate regular blood flow and to relax musculoskelatal stress.

Common sense dictates a preventative approach to RMD, so as to avoid surgery, splints, and outright disability. It is this preventative approach that the present invention addresses by offering a multipurpose device that will serve the purposes of the below cited prior art, while offering the user a wider use parameter than offered by the prior art in a manner not in conflict in any way with the prior art.

Moreover, the present invention will perform additional functions heretofore not offered by prior art in this field. i.e. the stowage of various effects such as pens, pencils, documents, etc.

Heretofore, a number of inventions have been offered in good faith to address the problems of RMD, though not always cited as such. Pertinent to the present invention, a number of forearm\wrist\appendage platforms, known in the vernacular as "wrist rests" have been offered, such wrist rests providing a surface upon which the computer keyboard user is able to support the underside of hisser forearms and or wrists while typing at a keyboard such as described above. These devices intend to reduce the musculoskeletal stress of holding the arms aloft while typing. Many other inventions have been offered to address RMD and associated problems. However, the wrist rest has appeared an inexpensive precautionary measure applicable to most ordinary work situations involving the use of computers.

As the reader will see, the prior art uniformly discloses single function devices upon which the user may support one or more appendages, the appendage(s) having a substantially fixed spatial relationship with the wrist rests during use. None disclose motion of the appendage across the surface of the rest upon which the appendage(s) is resting.

U.S. Pat. No. 4,973,176, issued to Jeffery A. Dietrich (Dec. 20, 1988) discloses an appendage rest which is adjustable for height so as to alter the working relationship between the user's appendage and a data input device. Dietrich does not discuss motion of the appendage itself across the appendage rest surface, nor multipurpose use of the device.

U.S. Pat. No. 4,976,407, issued to Edward M. Schwartz (1989) discloses a wrist rest attachable to a desk top and adjustable in vertical and horizontal directions. Schwartz does not show massaging capability nor the facilitation of the motion of the forearm across the top source of the rest.

U.S. Pat. No. 5,004,196, issued to Clifford Gross (1989), discloses a wrist support device which allows for transverse motion along the front (proximate to the user) edge of a keyboard. Gross's device is both complex of manufacture and operation, requiring adjustments to the device by the user. Further, Gross does not discuss facilitating motion back and forth along an axis perpendicular to the keyboard edge proximate to the user. Nor does Gross discuss a massaging motion or other uses for the device.

U.S. Pat. No. 5,040,757, issued to Dennis W. Benaway (1990) discloses a stepped wrist support which can, as with Schwartz, alter the spatial relationship between the user's arms and a keyboard. Benaway does not disclose facilitation of motion of the arms across the resting surface, nor multiple uses.

U.S. Pat. No. 5,088,668, issued to Thomas M. Grimm (1991) discloses a wrist rest consisting of interlocking semi cylindrical pieces which, when adjusted, alter the vertically measured relationship between the user's appendages and a keyboard. Grimm's, as those above, is an essentially static arrangement that does not facilitate motion of the foreams\wrists across the resting surface nor alternative uses.

U.S. Pat. No. 5,125,606, issued to Florence Cassano and Albert R. Nash (1991) discloses a wrist rest consisting of a rigid board covered with a compressed foam padding. Cassano and Nash do not teach a method for facilitating motion of the user's appendages across, while in contact with, the surface of the wrist rest, alternate uses of their invention, or a method for encouraging frequent changes in body position and massaging affected body parts.

In sum, the prior art does not disclose wrist rest devices which:

(1) allow for free, uninhibited motion of the supported appendage across the supporting surface of wrist rest in a manner consistent with the unique requirements of individual users;

(2) allow and\or encourage, through close proximity during work and prolonged contact, the user to utilize short breaks in the computer use routine due to running applications and programs etc., to regularly change the positions of the hands and arms by massaging them along the upper surface of the wrist support;

(3) can be used to massage the neck, back and various other parts of the user's body to sooth aches resulting from prolonged computer use;

(4) can serve multiple purposes as a holder for various work related objects;

(5) can marry any and\or all of the above functions with computer keyboard lap trays, pull-out drawers (adjustable and otherwise), computer keyboard housings, and the various other products which seek to allow for flexibility in the spatial relationship between the user's body and the input device.

OBJECTS AND ADVANTAGES

Several objects and advantages of the present invention are:

(a) to provide a multipurpose appendage support for users of computer equipment, (a support) which can be easily and economically manufactured and utilized by the user, and when properly used, may help to delay and\or avoid the onset of RMD (b) to provide a device which can alternately be utilized as such an appendage support as well as a massaging tool to relax muscles during periods of computer use (c) to provide such a device which facilitates movement of the supported appendage across the top surface of the device, thereby aiding the user's reaching of the various keys of a computer keyboard and\or mouse positions, without overly extending the finger and hand muscles, while using the keyboard or mouse or ten-key (d) to provide a multipurpose device which can serve as an appendage support while simultaneously retaining various work related items such a pens, pencils and\or documents, thereby making efficient use of work space (e) to provide an appendage support incorporating the above objects and advantages and which can be manufactured as part of, or incorporated with or into, removably or otherwise, one or more of the following: computer keyboard lap trays; computer keyboard pull-out drawers (adjustable or otherwise); chair attached or attachable keyboard trays; computer keyboard housings; and mouse pad units.

DRAWING FIGURES

Reference numerals in Drawings

1—beads with central through holes for support rods

2—cap nut

3—base

4—base ends

5—support rods

6—non-skid feet (optional)

7—phantom keyboard

8—Keyboard tray (invention built into the tray in this embodiment by bending support rod ends and embedding the rod ends into the upper surface of the tray)

9—netting or template

DESCRIPTION OF PREFERRED EMBODIMENT

Figure 1A:
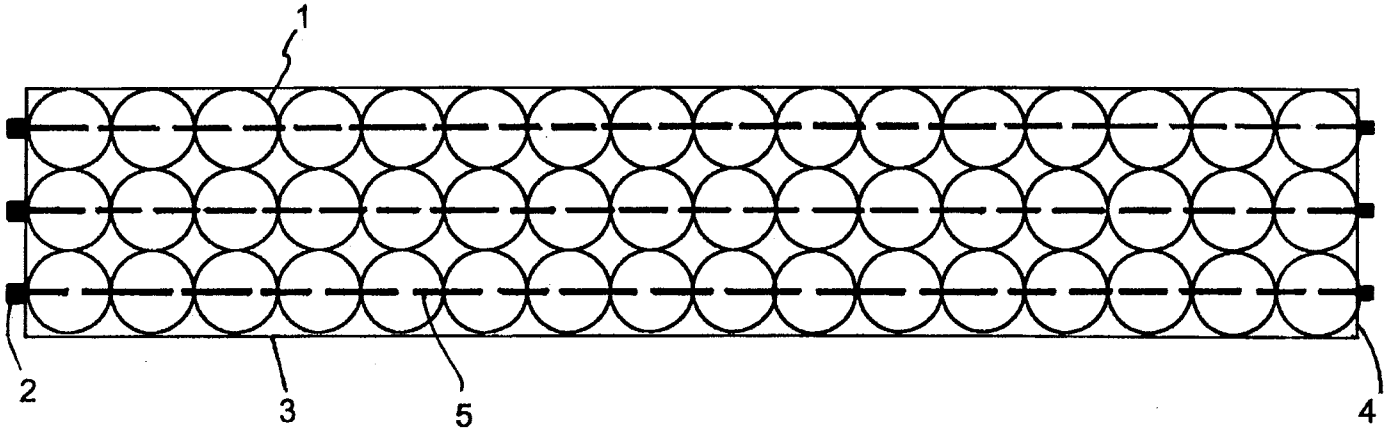
FIG. 1A is a top view of the appendage support showing the basic construction of the preferred embodiment, including all constituent parts.
Figure 1B:
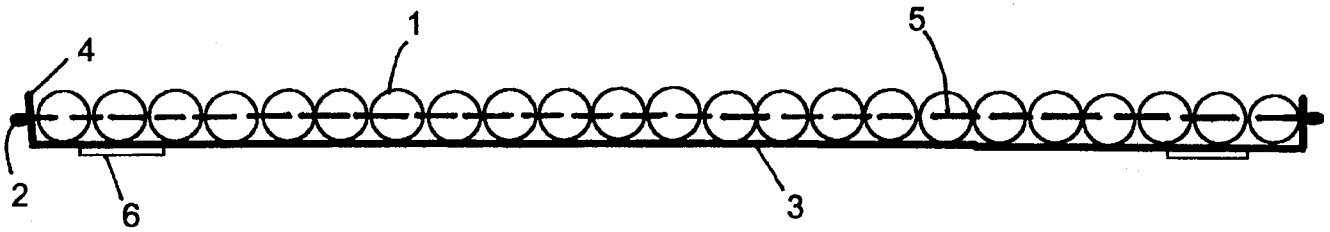
FIG. 1B is a side view of same.

A typical embodiment of the present invention is illustrated in FIG. 1A (top view) and FIG. 1B (side view) Depicted is base (3), flat along the bottom long axis and turned up at each end of the long axis so as to resemble an elongated "u". The base in the preferred embodiment is of 3/16" thick acrylic plastic, which can be easily heated to 270 to 350 degrees F. and bent to the desired shape. The base ends (4) should not extend vertically above the height of the top most surface of the beads (1), once the beads are suspended upon or over the upper surface of the base bottom, so as not to interfere with the user's arm movement across the beads at the furthermost ends of the device. However, such an extension would not render the device useless. The base can be constructed in a number of ways from a variety of materials, using construction techniques commonly associated with those materials. For example, wood may be used and substantially the same base shape can be achieved by cutting, laminating, bending, and or adding the base ends as separate pieces using fasteners and\or adhesives. Metals and other polymer plastics readily available could also be used. Acrylic is preferred here because of its light weight, flexibility, strength, cost, ease of bending, lack of substantial friction against the rotating beads, as well as for esthetic reasons.

The beads (or other similarly suspendable objects) are restrained to substantially the area of the base by support rods (5), in such a fashion as to allow the beads to be suspended slightly above, or in light contact with the base bottom upper side. The rods ( cold rolled steel in this embodiment, but any of a multitude of materials will suffice), one rod per row of beads along the long axis of the invention, are passed through the bead through holes so as to allow for smooth, even rotation of the bead about the rod. The rods are affixed to the base (in this embodiment) by passing the rod ends through through holes in the base ends, such holes having been drilled through the base ends at a height above the base bottom upper surface which is equal to and centered upon the radius of the beads used and in a relation to each other at each end of the base so as to fit the beads in rows across the long axis of the base. The latter can be achieved by drilling the first hole at one bead radius from one outer edge of the base along the long axis, drilling subsequent holes at one bead diameter from each other across the base end until the desired number of bead rows has been accounted for. Moreover, the base end through holes should be of sufficient size to allow passage of the support rod ends through them. The support rods are then secured to the base ends by affixing cap nuts (threaded or push on) or other suitable fasteners to the exposed support rod ends at the outer most sides of the base ends.

Finally, feet (6) composed of adhesive strips, H&L strips, felt or other non-skid and\or connective materials can be attached to the bottom most surface of the base either in such a fashion as to keep the device from sliding on the work surface upon which it rests and\or so as to effectively attach the device to the input equipment such as a keyboard, mouse pad etc. For example, matching strips of material with adhesive on one side and hook and loop fastener on the other can be attached to the undersides of the present invention and the input unit, thereby restricting the unintentional movement of the present invention to substantially the area of the input device. Moreover, such feet can be supplied in such a fashion as to allow the user to stack them to achieve alternate height and tilt relationships for the invention. Alternately, the feet may be omitted without substantially altering other aspects of the invention, so as to allow the invention to be easily moveable across the work surface.

Any of the constituent parts of the invention can be constructed of a wide variety of materials readily available on the market and well known to those skilled in the art. In the present embodiment, the beads are wooden and substantially spherical, although any shape such as barrel shape, oval, dowel sections etc. which allows for rotation about a supporting member could be used. The support rods in the present embodiment are of cold rolled steel, which is somewhat flexible yet retains substantial rigidity and tensile memory. The cap nuts in the present embodiment are nickle plated steel, push on type, although many different types are available and would suffice. The base construction, whether suspended or not by feet, blocks, or other supporting mechanisms above the work surface, together with the height of the beads measured by their diameters, should approximate, within reasonable limits, the height of the keyboard or other input device measured at the edge proximate to the user. Thus one may use taller beads and a shorter base or visa versa to achieve optimum height.

Moreover, the base end through holes can be drilled, and the beads, support rods, and cap nuts etc. arranged in such a fashion as to give the overall upper surface of the device a curved appearance if desired. In addition, myriad obvious techniques can be utilized by one skilled in the art so as to obviate the need for the cap nuts, depending on the materials used and mode of construction and other considerations.

Figure 3:
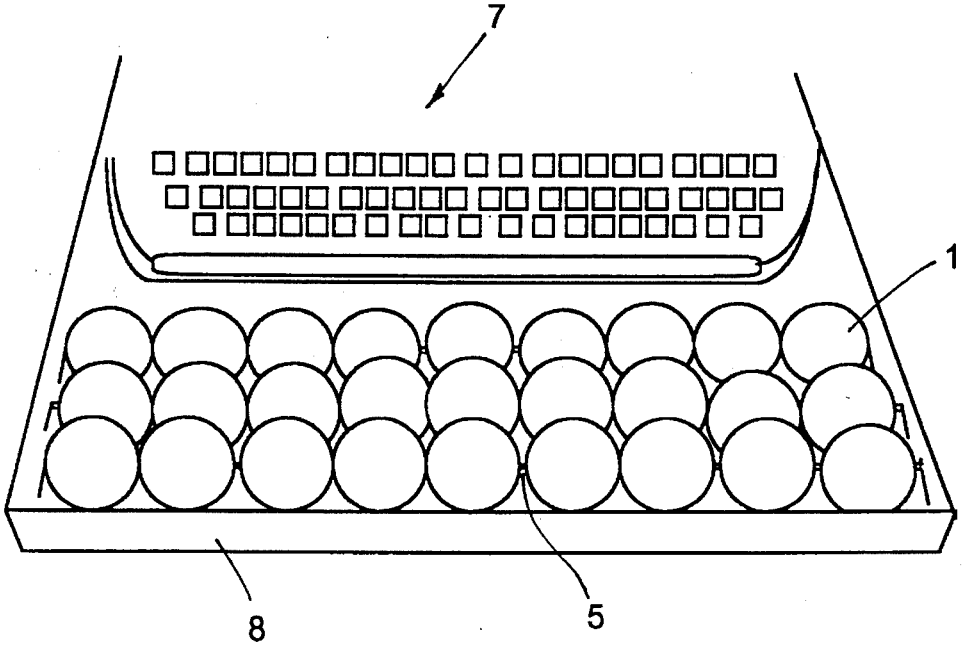
FIG. 3 shows the invention manufactured into a computer keyboard tray.
Figure 4:
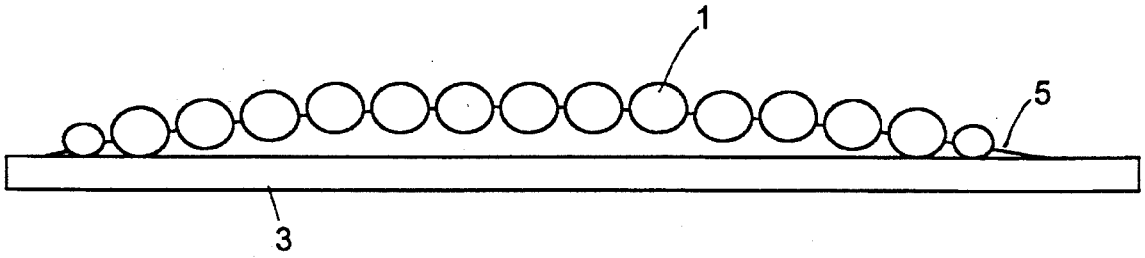
FIG. 4 shows an embodiment where beads are secured by a curved rod providing an arching support.

Additionally, in certain embodiments the base end pieces may be omitted. For example, when manufacturing the device into a computer keyboard tray (8) (see FIG. 3) or mouse pad, the support rods could be attached directly to the body of the tray or pad. Alternatively, in a stand alone embodiment, shown in FIG. 4 the support rods 5, if rigid enough, can be shaped so as to curve downwards toward the base bottom at the outermost ends along the long axis and be attached to and\or embedded in the base bottom itself.

SUMMARY, RAMIFICATIONS, AND SCOPE

A multipurpose massaging appendage support for users of computer input devices, designed according to the principles of the present invention allows, in the preferred embodiment, the user to support his\her forearms and or wrists upon the uppermost surface of the support, rolling the forearms\wrists back and forth across the beads, comprising the uppermost surface as required or desired to reach the various keys and\or mouse positions, depending upon the hand size, finger length or other physical attributes of the user. Further, the device allows the user, as desired, to massage his\her hands, fingers etc. by moving them across the uppermost surface, of the invention while those body parts are in contact with that surface, rapidly, slowly, smoothly or in any manner desired. Moreover, the invention will be able to be utilized by the user to massage different body parts such as the neck, back, legs etc. by the user's picking up the invention in his/her hands and pressing the normally uppermost surface against the relevant body part and rolling the invention back and forth or otherwise across the body part, by having the massaging uppermost surface exposed to a degree that facilitates this use. In addition, the invention may be used as stowage for pens, pencils, documents and other related work items while being used as an appendage support.

Figure 2:
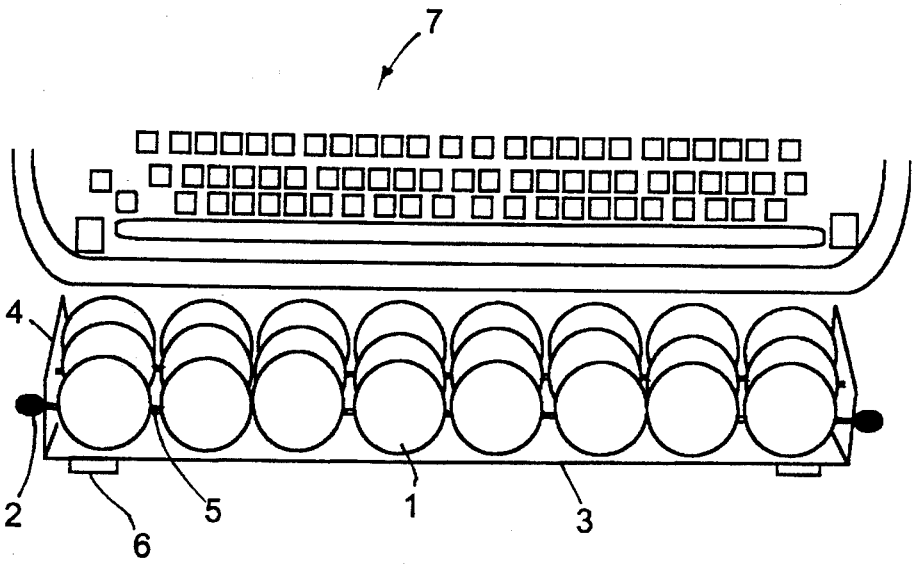
FIG. 2 shows the invention in proximity to a computer keyboard.

The present invention can be used as a stand alone unit in concert with input devices by placing it upon a work surface in proximity to the input device and\or incorporated into a keyboard tray or drawer (FIGS. 2&3 ), or keyboard housing or mouse pad, either fixedly or removably, depending upon the range of use objectives the manufacturer desires to incorporate.

Figure 5:
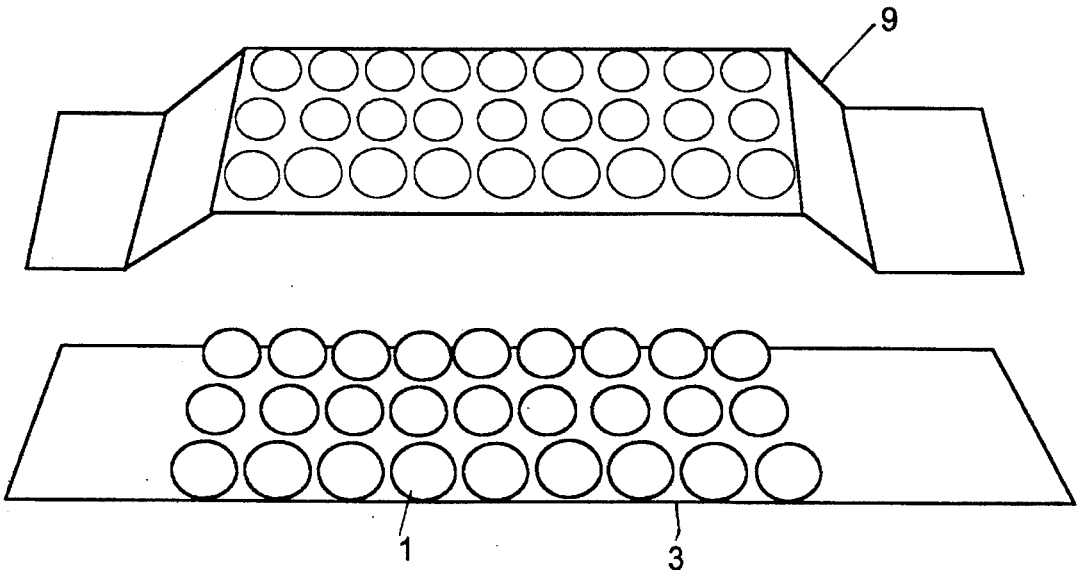
FIG. 5 shows an embodiment where beads are overlaid by a thin material with openings.

Although the descriptions, objects, and advantages above contain several specifications, these ought not be construed by the reader nor anyone else as limiting the scope of the invention but as merely providing illustrations of some of the presently preferred embodiments of this invention. For example, as shown in FIG. 5 alternative methods of attaching the beads or other suspendable objects may be utilized, such as netting or template 9 which would allow the beads etc. to be held in place while also exposing the upper surfaces of the beads to facilitate motion of the appendages etc. across the exposed surface while in contact with those surfaces. The size, and number of rows of beads can be altered in proportion to the desired height, width, and length of the base. The materials used in the construction of the invention, as mentioned above, can be altered in a number of ways according to the desired flexibility, costs, durability or other design requirements. As mentioned above, certain pieces may be omitted (other than the beads or other suspendable and rotatable objects ) according to the targeted embodiment. Thus the scope of the invention should be determined by the appended claims and their legal equivalents, rather than by the examples given.

OPERATION OF THE INVENTION

The reader will be able to see from FIG. 1A, 1B, 2, & 3, that the present invention consists of rows of beads, or other suspendable, rotatable objects suspended longitudinally by support rods slightly above, or lightly in contact with the uppermost flat side of a base bottom. The user rests or otherwise supports his\her forearms\wrists upon the uppermost surfaces of the beads, crossing the suspended bead rows perpendicularly while accessing a data input device or command input device in close proximity to the invention. As the user accesses different keys, or changes mouse positions, the forearms\wrists of the user easily actuate a rolling motion of the beads back and forth in concert with the arm movement. Moreover, the user can place her\his palms, fingers, backs of the hands etc. in contact with the beads during micro-breaks in the work routine and by actuating a similar rolling motion can utilize the invention to massage the hands etc. in order to relieve muscle stress. In addition, the user can lift the invention, and by activating a similar rolling motion with the uppermost surfaces of the beads in contact with other body parts, can massage those other body parts.

Additionally, the reader will see that, since the beads are suspended above or in light contact with the base, and since the shape of the beads leaves areas of empty space between the those portions of the beads which occupy the areas of the beads above and below the horizontal dissecting planes of the beads, the user can stow small and\or flat objects between and\or beneath the beads or in the wells between the rows of beads in either direction, perpendicular to, or parallel with the long axis of the base.

Lastly, I have found through testing the invention in actual working environments with professional computer users that the feel and look of the invention have an effect on the user that causes the user to be encouraged to use micro-breaks in the work routine to massage the hands and other body pans, with the overall effect of reducing the pains and stiffness commonly associated with prolonged computer use. This effect could be psychological in nature. However, users have found it to be beneficial in any case.

I claim:

1. An arm or wrist support for users of electronic computing devices, comprising:

a base having a bottom surface and a top surface with an upwardly extending side wall at each end of said top surface defining a space above the top surface and between the side walls:

bead means secured within said space by rod means in a way that the bead means are suspended slightly above, or in light contact with the top surface allowing for rotational movement of the bead means; and fastening means securing said rod means to said base;

wherein the user's arms or wrists will be supported upon the bead means and will receive a massage effect due to the rotational movement of the bead means against the arms and or wrists; and wherein the bead means are located above only a front portion of the top surface of the base while a back portion of the top surface provides a tray upon which an interface device for the electronic computing device may be placed so that the bead means are positioned to support the arms and wrists while the user operates the interface device.

2. An arm or wrist support for users of electronic computing devices, comprising:

a base having a bottom surface and a top surface;

beads resting upon said top surface and overlayed by a thin material having openings, with certain openings in the material corresponding to beads, said openings being smaller than the bead diameters, allowing a portion of the beads to extend through the openings and allowing the beads to rotate about a plurality of axes while remaining secured between said top surface and said overlaying material;

wherein the beads and the top surface tend to be smooth so that there is not substantial friction to impede rotation thereby providing a massage effect due to the rotation of the beads against the arms and wrists when the arms and wrists are supported thereon.

3. An arm or wrist support for users of electronic computing devices, comprising;

a base having a bottom surface and a top surface;

at least one rod, having a first and second rod end, the rod being secured so that the major length of the rod is held above said top surface of the base;

a number of beads, said beads having bores extending therethrough, and being rotatably secured by said rod extending through the bores, allowing for said beads to rotate about the axis of the rod;

wherein the base further comprises a first upwardly extending side wall at an end of said base, and a second upwardly extending side wall at an opposite end of said base, whereby a space is defined above the top surface and between the side walls; and wherein said at least one rod is located essentially parallel to, and entirely above, said top surface; and wherein a first end of said rod is secured in the first side wall and a second end of each rod is secured in the second side wall.

4. The arm or wrist support of claim 3, wherein the beads and the top surface tend to be smooth, and the beads are secured in light contact with said top surface so the there is not substantial friction to impede bead rotation; thereby allowing the user's arms and or wrists to receive a massage effect due to the rotation of the beads against the arms and or wrists when the arms and or wrists are supported thereon.

5. The arm or wrist support of claim 3, wherein the beads are secured slightly above said top surface, and wherein the user's arms and or wrists will be supported upon the beads and will receive a massage effect due to the rotation of the beads against the arms and or wrists.

6. The arm or wrist support of claim 5, wherein the rod is rigid enough to support the user's arms and or wrists, but flexible enough so that the rod tends to bend slightly under the weight of the user's arms and or wrists and thereby enhances the massage effect.

7. The arm or wrist support of claim 6, wherein the rod ends are secured by fasteners.

* * * * *